US005900357A

United States Patent [19]

Feumi-Jantou et al.

[11] Patent Number: 5,900,357

[45] Date of Patent: May 4, 1999

[54] PRODUCT FOR INDUSTRIAL RADIOGRAPHY HAVING IMPROVED CONTRAST

[75] Inventors: Christiane M. Feumi-Jantou, Chalon-Sur-Saône; Gérard M. Droin, Beaune; Yannick Begel, Chalon sur Saône, all of France

[73] Assignee: Eastman Kodak Company, Rochester, N.Y.

[21] Appl. No.: 08/943,951

[22] Filed: Oct. 3, 1997

[30] Foreign Application Priority Data

Dec. 13, 1996 [FR] France ..... 9615610

[51] Int. Cl.[6] ..... G03C 5/16

[52] U.S. Cl. ..... 430/570; 430/139; 430/966; 430/967

[58] Field of Search ..... 430/570, 139, 430/966, 697, 567, 585

[56] References Cited

U.S. PATENT DOCUMENTS

| | | | |
|---|---|---|---|
| 4,609,621 | 9/1986 | Sugimoto et al. | 430/567 |
| 4,692,401 | 9/1987 | House . | |
| 5,290,655 | 3/1994 | Iwasaki | 430/139 |

FOREIGN PATENT DOCUMENTS

| | | |
|---|---|---|
| 0 425 884 A1 | 8/1991 | European Pat. Off. . |
| 0 538 947 A1 | 4/1993 | European Pat. Off. . |

OTHER PUBLICATIONS

Chemical Abstracts, vol. 53, No. 10, 1959, Abst No. 8900, "Change of Contrast of Photographic Layers by Optical Sensitization", H. Zwicky.

*Primary Examiner*—Thorl Chea
*Attorney, Agent, or Firm*—Carl O. Thomas

[57] ABSTRACT

The present invention concerns a silver halide radiographic product intended for industrial radiography as well as a novel radiographic system and a method for forming the radiographic image.

The present invention concerns a photographic product designed to be exposed to X or γ radiation, which comprises a support covered on at least one face with a layer of silver halide emulsion which contains an efficient amount of at least one free spectral sensitizing dye.

This product, intended for industrial radiography, exhibits improved contrast.

12 Claims, No Drawings

PRODUCT FOR INDUSTRIAL RADIOGRAPHY HAVING IMPROVED CONTRAST

FIELD OF THE INVENTION

The present invention concerns a silver halide radiographic product designed to be exposed to X or γ rays as well as a novel radiography system and a method for forming the radiographic image. In particular, the present invention concerns a product for industrial radiography having improved contrast.

DEFINITION OF TERMS

In referring to grains and emulsions containing two or more halides, the halides are named in order of ascending concentrations.

The term "equivalent circular diameter" or "ECD" is employed to indicate the diameter of a circle having the same projected area as a silver halide grain.

The term "aspect ratio" designates the ratio of grain ECD to grain thickness (t).

The term "tabular grain" indicates a grain having two parallel crystal faces that are clearly larger than any remaining crystal faces and having an aspect ratio of at least 2.

The term "tabular grain emulsion" indicates an emulsion in which tabular grains account for greater than 50 percent of total grain projected area.

*Research Disclosure* is published by Kenneth Mason Publications, Ltd., Dudley House, 12 North St., Emsworth, Hampshire P010 7DQ, England.

BACKGROUND

Industrial radiography is a technique for the non-destructive testing and analysis of defects in components such as glass, paper, wood or metal components. This technique is widely used in aeronautics, the nuclear industry or the petroleum industry as it makes it possible to detect welding defects or defects in the texture of materials in aircraft, nuclear reactor or pipeline components.

This technique consists of exposing a metallic component to be analyzed to an ionizing radiation, in general X or γ rays, with an energy lying between 10 and 15,000 kV. With this technique it is therefore necessary to use special radiographic products which are sensitive to this ionizing radiation.

The sensitivity of radiographic emulsions to X or γ rays is due to the absorption of some of these rays by the silver halide grains, which causes a secondary emission of electrons which will form an internal latent image. Consequently the ionizing radiation is effective only to the extent it can be absorbed by these grains.

Unfortunately, it is known that the major part of the ionizing radiation passes through the silver halide grains without being absorbed. Only a very small part of the incident radiation (less than 1%) is absorbed and participates in the formation of developable latent image seeds.

It is known to employ an intensifier with an industrial radiographic product. The intensifier typically takes the form of a metallic foil that intercepts a portion of the X or γ radiation and emits electrons that interact with the silver halide grains to form latent image sites.

These intensifiers are not to be confused with intensifying screens used in medical diagnostic radiographic products. In medical diagnostic imaging much lower energy levels of X radiation are employed. Again, only a small portion of the X radiation is absorbed by the silver halide grains. To increase absorption an intensifying screen is employed that absorbs X radiation and emits light. This is achieved by coating phosphor particles in a binder and coating on a support to form the intensifying screen. When light is emitted to the intensifying screen to the medical diagnostic radiographic product that lies outside the spectral region of native sensitivity of the silver halide grains, then a spectral sensitizing dye is employed having its maximum absorption wavelength matched to a primary emission wavelength of the intensifying screen. To transfer energy from the dye, where emitted light is absorbed, to the silver halide grains, it is necessary to adsorb the dye to the surface of the silver halide grains.

In medical diagnostic imaging the high surface to volume ratios of tabular grains allows higher amounts of sensitizing dye to be absorbed, and tabular grain emulsions are therefore generally preferred. Products for industrial radiography instead rely upon the silver halide itself to capture latent image forming radiation. Therefore, nontabular grains (regular grains and irregular grains with low aspect ratios) are most commonly employed. However, films for industrial radiography comprising tabular grain emulsions are known. U.S. Pat. No. 4,883,748 describes a film for industrial radiography in which the silver halide emulsion comprises silver halide grains having an average aspect ratio less than or equal to 5 (and preferably between 1 and 3) and whose surface region contains more iodide than the internal region.

SUMMARY OF THE INVENTION

An aim of the present invention is to provide a novel product for industrial radiography which is sensitive to X or γ radiation and whose sensitometric quantities are improved. In particular, this novel radiographic product exhibits an increase in contrast without increase in the silver content. It is also compatible with ascorbic acid processing baths.

In one aspect this invention is directed to a radiographic product designed to be exposed to X or γ radiation with an energy greater than or equal to 10 kV, which comprises a support covered on at least one face with a layer of emulsion comprising silver halide grains dispersed in a binder, wherein the emulsion contains a free spectral sensitising dye in an amount sufficient to increase contrast.

DESCRIPTION OF PREFERRED EMBODIMENTS

In the context of the invention, "free spectral sensitizing dye" means a dye which is not absorbed on the silver halide grains of the emulsion but dispersed in the binder. This free dye does not provide chromatization of the emulsion since chromatization is due to the formation of aggregates on the silver halide grains.

Surprisingly, it has been found that the presence of at least one free spectral sensitizing dye makes it possible to substantially increase the contrast of the product without impairing the other sensitometric properties of the product.

In order to obtain a radiographic product comprising a free spectral sensitizing dye, suitable spectral sensitizing dyes are photographic spectral sensitizing dyes which are not adsorbed on the silver halide grains by virtue of the very nature of the dye, or by virtue of the structure and/or composition of the silver halide grains constituting the emulsion.

It is also possible to use a sensitizing dye which has a tendency to be adsorbed on the silver halide emulsion grains.

In this case, the quantity of dye introduced into the radiographic product must be such that, in spite of the adsorption of the spectral sensitizing dye on the grains, an efficient amount of spectral sensitizing dye remains free. It is also possible, in the case of a spectral sensitizing dye which has a tendency to be adsorbed, to modify this tendency by the addition of compounds known to desorb the sensitizing dye adsorbed on the silver halide grains. These compounds are for example tetrazole compounds such as the sodium salt of 5-methyl-S-triazolo(2,3-A)-7-pyrimidinium.

According to the present invention, it is preferable to use either dyes which are not adsorbed, or dyes which have been chemically desorbed.

Provided that they meet the criteria defined above, the spectral sensitizing dyes which can be used in the context of the invention are conventional sensitizing dyes known in the field of photography. These dyes are described in *Research Disclosure,* September 1994, No 36544, section V (hereinafter referred to as *Research Disclosure*). These conventional sensitizing dyes are polymethine dyes, which comprise cyanines, merocyanines, complex cyanines and merocyanines, oxonols, hemioxonols, styryls, mereostyryls, streptocyanines, hemicyanines and arylidenes.

The spectral sensitizing dyes which can be used for the invention are for invention derivatives of sulfurpropylthiocyanines, carbocyanines or benzoxazoles.

In the context of the invention, an efficient amount of free spectral sensitizing dye is the amount of free dye which makes it possible to obtain an effect on the contrast. This efficient amount varies widely according to the spectral sensitizing dye used, the shape and silver halide composition of the grains forming the emulsion and the different compounds present in the emulsion.

With the spectral sensitizing dyes which have been used in the examples, the efficient amount of free sensitizing dye is at least equal to 5 mmol/mol Ag. Preferably, this efficient amount is between 15 mmol/mole Ag and 1 mmole/mol Ag.

The silver halide emulsions which can be used in the context of the invention are emulsions used in a conventional fashion in industrial radiography.

These emulsions can be of highly varied forms, structures and compositions.

These emulsions can be emulsions with nontabular grains. Common regular nontabular grains include cubic, octahedral and cubooctahedral grains. The tabular grains can exhibit edge and/or corner rounding, due to ripening, of varied degrees. Irregular grains are also contemplated. Preferred irregular grains are tabular grains. Conventional emulsions containing regular and irregular grains, particularly tabular grain emulsions, are described in *Research Disclosure,* Section I. Conventionally, products for industrial radiography typically contain cubic-grain emulsions.

Advantageously, it is possible to reduce the silver content of these products by using tabular grain emulsions. While tabular grain emulsions can have any convenient average aspect ratio greater than 2, these emulsions for industrial radiographic applications preferably have average aspect ratios between 10 and 20. In these tabular grain emulsions the tabular grains preferably account for at least 70% and most preferably at least 90% of total grain projected area.

With a radiographic product containing tabular grains, it is possible to use silver contents up to 25% less than the silver contents of conventional radiographic products containing emulsions with thick or three dimensional grains. Films for industrial radiography containing tabular grain emulsions are described in U.S. Ser. No. 08/682,975, filed Jul. 16, 1996, titled NEW ELEMENT FOR INDUSTRIAL RADIOGRAPHY, commonly assigned, the disclosure of which is here incorporated by reference.

The silver content of the radiographic product is generally between 50 and 300 mg/dm$^2$.

The emulsions which can be used in the context of the present invention preferably consist essentially of silver bromide, that is to say the bromide constitutes the majority halide of the emulsion. The silver halide grains which can be used in the context of the invention may therefore contain silver iodide or silver chloride. According to one embodiment, the emulsions of the photographic product of the invention contain at least 90% silver bromide. These grains can contain a quantity of chloride or iodide below 5%.

According to a preferred embodiment, the silver halide grains of the emulsions for industrial radiography are silver iodobromide grains containing a quantity of iodide of less than 3 mole % iodide, based on silver, where the iodide can be located in a part of the volume of the silver halide grain or uniformly distributed throughout this volume.

The emulsions of the radiographic product of the present invention comprise silver halide grains dispersed in a binder, which is conventionally a water-permeable hydrophilic colloid such as gelatin, gelatin derivatives, albumin, a polyvinyl alcohol, polyvinyl polymers, etc.

The silver halide emulsions may contain doping agents, generally in small quantities such as ions of rhodium, indium, osmium, iridium etc (see Section I-D3 of *Research Disclosure*). These doping agents are generally introduced during the precipitation of the emulsions.

The silver halide emulsions can be chemically sensitised according to the methods described in Section IV of *Research Disclosure*. The chemical sensitizer generally used are compounds of sulphur and/or selenium and gold. It is also possible to use sensitisation by reduction.

Conventionally, the radiographic emulsions are chemically sensitised with sulphur and gold. The quantity of sulphur is generally between 9 and 18 mg/mol Ag and the sulphur/gold ratio is between 0.5 and 3 and preferably close to 2.

The silver halide emulsions can optionally contain varied conventional addenda, such as optical brighteners, antifogging compounds, surfactants, plasticisers, lubricants, hardening agents, stabilisers, absorption and/or diffusion agents as described in Sections II-B, VI, VII, VIII and IX of *Research Disclosure.*

The radiographic product of the invention can optionally contain, in addition to the silver halide emulsion, other layers which are conventional in radiographic products such as protective layers (a top layer), intermediate layers, filter layers or anti-halation layers. The support can be any suitable support used for products for industrial radiography. The conventional supports are polymer supports such as ethylene polyterephthalate.

The top layer can contain anti-static agents, polymers, matting agents, etc.

Preferably, the products for industrial radiography of the invention comprise a support covered on both faces with a silver halide emulsion, at least one of the two emulsions comprising a free spectral sensitizing dye as described previously. The emulsions situated on each side of the support can be identical or different in size, composition, silver content, etc.

According to a particular embodiment, the support is covered on each of its faces with a layer of emulsion containing a free spectral sensitizing dye as described previously.

The hydrophilic colloid layer or layers of the radiographic product of the invention can be hardened by means of hardening agents as described in *Research Disclosure*, Section II.B. These hardening agents can be organic or inorganic hardening agents such as chromium salts, aldehydes, N-methylol compounds, dioxane derivatives, compounds comprising active vinyl groups, compounds comprising active halogens, etc.

The radiographic product of the present invention can be used in the form of a radiographic system comprising 2 intensifier screens for X rays, disposed on each side of the radiographic product as defined previously.

These intensifier screens are screens which increase the proportion of ionizing rays absorbed by the silver halide grains. The X rays interact with the intensifier screen, producing electrons in all directions. Some of these electrons will be absorbed by the silver halide grains of the layer of emulsions in order to form latent image sites. By increasing the number of electrons emitted in the direction of the grains, the quantity of electrons absorbed by the grains is increased. These screens are generally metallic screens.

The screens normally used are in the form of a sheet of lead, lead oxide, or dense metals such as copper or steel. The thickness of these screens is between 0.025 mm and 0.5 mm, and depends on the type of ionised rays used.

The radiographic image is obtained by exposing a radiographic product as described previously to X or γ radiation, either directly or through an intensifier screen, and developing the latent image of the exposed product.

The processing methods for industrial radiography comprise a black and white development bath containing a developer and a fixing bath comprising a solvent for silver halides such as thiosulphate, thiocyanate or sulphured organic compounds. Conventional developers are generally dihydroxybenzene, 3-pyrazolidone or aminophenol compounds. Use can also be made of a ascorbic acid or a derivative of ascorbic acid derivative developer.

The present invention is illustrated by the following examples, which shows the sensitometric advantages of the invention.

EXAMPLES

Format of the radiographic element

Unless otherwise indicated, the radiographic products used in the following examples employed a polyethylene terephthalate film support covered on each face with a layer of a tabular grain emulsion with a silver content of 75 mg/dm$^2$ (total silver content 150 mg/dm$^2$). Each layer of silver halide emulsion is covered with a protective layer consisting of gelatin containing a matting agent.

The product was hardened with a quantity of bis (vinylsulphonylmethyl)ether of between 0.5 and 2.5% by weight of total dry gelatin contained in the product.

The tabular grains accounted for more than 90% of total grain projected area.

The emulsion was prepared by double-jet precipitation using the accelerated flows technique described in U.S. Ser. No. 08/682,975, filed Jul. 16, 1996, incorporated here by reference. After the precipitation and washing of the silver halide emulsion, the emulsion was chemically sensitised by means of sulfur and gold, the quantity of sulfur being around 95 mmole/mol Ag, the quantity of gold being around 21 mmole/mol Ag.

The emulsion was then kept at 65° C. for 15 min., and then the spectral sensitizing dye or dyes were added in sufficient quantity to have free dye in the dispersion medium.

Each radiographic product is placed between two lead screens (25 μm) with copper filtration of 8 mm, and then exposed to X rays at a voltage of 220 kV and a current of 10 mA.

After exposure, each product was developed using a Kodak MX800® process for industrial radiography (12 min., 27° C., dry-to-dry), which comprises a hardening developing step with a hydroquinone/Phenidone developer (2.5 min.), a fixing step (2.5 mins), a washing step (2.5 min.) and a drying step.

For each sample, the speed of the film was measured (100(1-Log E), Log E being the logarithm of the exposure for obtaining a density of 2 above the Dmin (density of support+fog)) and the contrast (the slope of the sensitometric curve between the points of density D=1.5 and D=3.5).

The quantity of free sensitizing dye was measured by eluting in a loop a given surface area of the film developed with a water-ethanol mixture (1:1 volume ratio) which entrained the free sensitizing dye. The solution containing the dye was continuously treated in a spectrophotometer in order to measure the optical density which corresponds to the spectral sensitizing dye. This operation was continued until the optical density is stable. The same sample was then processed with a concentrated photographic fixer in order to solubilise the silver halide grains, and the dye which was fixed on the grain is thus released. The fixer containing the released dye was treated as before with the spectrophotometer in order to measure the optical density which corresponds this time to the quantity of dye initially fixed. The ratio between the two optical density measurements gives the % of free dye in the photographic product.

The spectral sensitizing dyes used in the following examples:

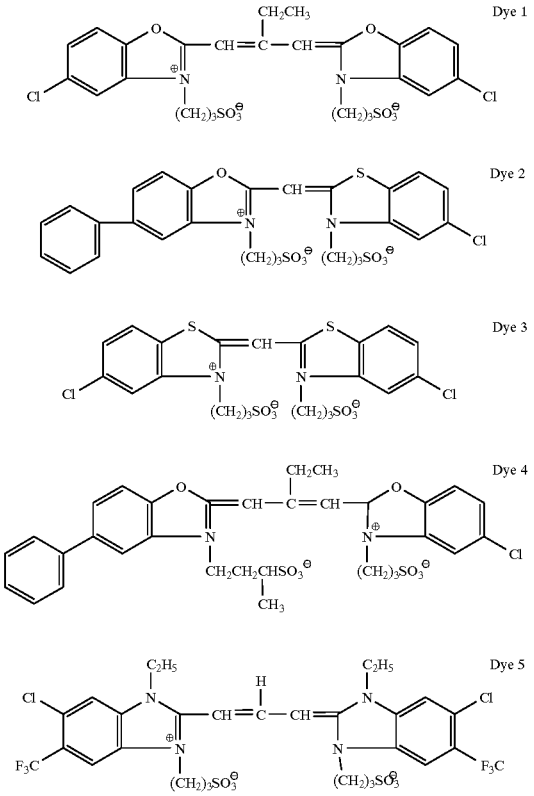

Example 1

In this example, the radiographic product with the format described previously was used, which comprises an AgIBr tabular grain emulsion (1 mole % I), the iodide being uniformly distributed in the grains (ECD=1.02 μm, t=0.096 μm).

The spectral sensitizing dye used is oxocarbocyanine Dye 1. The quantities used and the sensitometric results are set out in the following table:

TABLE I

| Quantity of dye introduced | % of free dye | RELATIVE SPEED | CONTRAST |
|---|---|---|---|
| 0 | — | 100 | 4.91 |
| 300 mg/mol Ag | 50% | 93 | 5.09 |
| 600 mg/mol Ag | 60% | 88 | 5.54 |

This example shows the effect of the free spectral sensitizing dye on the contrast with a radiographic product exposed to X-rays.

Example 2

(comparative)

In this example, the radiographic product with the format described previously is used, which comprises an AgIBr tabular grain emulsion (1 mole % I), the iodide being uniformly distributed in the grains (ECD=0.8 μm, t=0.102 μm).

The spectral sensitizing dye used is Dye 2. The quantities used and the sensitometric results are set out in the following table:

TABLE II

| Quantity of dye introduced | % of free dye | RELATIVE SPEED | CONTRAST |
|---|---|---|---|
| 0 | — | 100 | 4.8 |
| 300 mg/mol Ag | 4% | 98 | 4.8 |
| 600 mg/mol Ag | 5% | 92 | 4.75 |

This example shows that, when the dye is not free, it no longer has any effect on the contrast.

Example 3

In this example, the radiographic product with the format described previously is used, which comprises an AgIBr tabular grain emulsion (1 mole % I), the iodide being uniformly distributed in the grains (ECD=1.07 μm, t=0.09 μm).

For each sample, the sensitizing dye used and the sensitometric results obtained are set out in Table III.

The quantity of spectral sensitizing dye initially introduced in the following samples is 300 mg/mol Ag.

TABLE III

| Spectral sensitizing dye | % of free dye | RELATIVE SPEED | CONTRAST |
|---|---|---|---|
| no dye | — | 100 | 4.8 |
| Dye.1 | 50 | 96 | 5.6 |
| Dye.2 | 4 | 97 | 4.8 |
| Dye.3 | 15 | 94 | 5 |
| Dye.4 | 64 | 96 | 5.7 |
| Dye.5 | 100 | 84 | 5.2 |

Example 4

In this example, the radiographic product with the format described previously was used, which comprises an AgIBr nontabular grain emulsion (1.7 mole % I), the iodide being uniformly distributed in the grains (mean ECD=0.22 μm), with a silver content of 190 mg/dm$^2$. This emulsion is sensitized with a quantity of sulfur of 60 mmol/mol Ag and a quantity of gold of around 26 mmol/mol Ag. After the addition of the chemical sensitisers, the emulsion is maintained at 66° C. for 9 min.

The spectral sensitizing dye used is Dye 1. The quantities used and the sensitometric results are set out in the following table:

TABLE IV

| Quantity of dye introduced | % of free dye | RELATIVE SPEED* | CONTRAST |
|---|---|---|---|
| 0 | — | 100 | 5.67 |
| 150 mg/mol Ag | 50 | 97 | 7.82 |
| 300 mg/mol Ag | 55 | 95 | 8.43 |
| 600 mg/mol Ag | 60 | 92 | >9 |

This example shows that the effect of the free spectral sensitizing dye on the contrast is obtained with nontabular grains.

Example 5

In this example, the radiographic product with the format described previously was used, which comprises an AgBr tabular grain emulsion (ECD=0.53 μm, t=0.103 μm).

The spectral sensitizing dye used is Dye 1. The quantities used and the sensitometric results are set out in the following table:

TABLE V

| Quantity of dye introduced | % of free dye | RELATIVE SPEED | CONTRAST |
|---|---|---|---|
| 0 | — | 100 | 5.1 |
| 300 mg/mol Ag | 50 | 95 | 5.7 |
| 600 mg/mol Ag | 60 | 88 | 6.6 |

This example shows that the effect of the free spectral sensitizing dye on the contrast is obtained with pure bromide grains.

Example 6

In this example, the radiographic product having the format described previously was used, which comprises an AgIBr tabular grain emulsion (0.4 mole % I) (ECD=0.46 μm, t=0.15 μm, sulfur and gold chemical sensitization S=120 mmol/mol Ag, Au=26 mmol/mol Ag).

In Example 6.1, the spectral sensitizing dye used is Dye 1 (300 mg/mol.Ag).

In Example 6.2, Dye 1 was used (300 mg/mol Ag) in combination with potassium iodide (300 mg/mol Ag). The addition of potassium iodide promoted adsorption of the spectral sensitizing dye by modifying the surface of the grains.

Example 6.3 is a control sample which contained neither dye nor KI.

The sensitometric results are set out in the following table:

TABLE VI

| | % of free dye | RELATIVE SPEED* | CONTRAST |
|---|---|---|---|
| Ex.6.1 (Dye.1) | 60 | 95 | 6.0 |
| Ex.6.2 (Dye.1/KI) | 5 | 98 | 5.7 |
| Ex.6.3 (sample) | — | 100 | 5.7 |

These results show that, when the adsorption of the spectral sensitizing dye Dye 1 on the silver halide grains (reduction of free dye) is promoted, for the same initial quantity of dye, a reduction in contrast is observed. This example clearly shows that the effect on contrast is related to the presence of free dye in the radiographic product.

The invention has been described in detail with particular reference to preferred embodiments thereof, but it will be understood that variations and modifications can be effected within the spirit and scope of the invention.

What is claimed is:

1. A radiographic product designed to be exposed to X or γ radiation with an energy greater than or equal to 10 kV, which comprises a support covered on at least one face with a layer of emulsion comprising silver halide grains dispersed in a binder, wherein the emulsion contains at least one free spectral sensitizing dye in an amount sufficient to increase contrast.

2. A radiographic product according to claim 1, in which the silver halide is silver bromide or silver iodobromide in which the quantity of iodide is less than 5 mole percent, based on silver.

3. A radiographic product according to claim 2, in which the silver iodobromide contains less than 3 mole percent iodide, based on silver.

4. A radiographic product according to claim 1, in which the silver halide emulsion is a tabular grain emulsion.

5. A radiographic product according to claim 1, in which the amount of free spectral sensitizing dye is at least 5 mmol/mol Ag.

6. A radiographic product according to claim 5, in which the quantity of free dye is between 1 mmol/mol Ag and 15 mmol/mol Ag.

7. A radiographic product according to claim 1, in which the silver content of the emulsion layer on at least one face of the support is between 50 and 200 mg/dm$^2$.

8. A radiographic product according to claim 1, in which the support is covered on both faces with a layer of silver halide emulsion.

9. A system for industrial radiography comprised of a radiographic product according to any one of claims 1 to 8 inclusive and an intensifier screen for X and γ rays, disposed adjacent each face of the radiographic product covered with an emulsion layer.

10. A method for forming an industrial radiographic image, which comprises the steps of exposing a radiographic product according to claim 1 to X or gamma radiation with an energy greater than or equal to 10 kV, either directly or through an intensifier screen for X or gamma rays, in order to form a latent image, and developing the latent image.

11. A method according to claim 10, in which the latent image is developed in a development bath which contains ascorbic acid as a developer.

12. A method according to claim 10, in which the latent image is developed in a development bath which is free of a hardening agent.

* * * * *